US009873960B2

(12) United States Patent
Ueding et al.

(10) Patent No.: US 9,873,960 B2
(45) Date of Patent: Jan. 23, 2018

(54) TEXTILE MACHINE WITH VARIABLE TENSION DRAFT

(71) Applicant: Rieter Ingolstadt GmbH, Ingolstadt (DE)

(72) Inventors: Michael Ueding, Ingolstadt (DE); Jürgen Müller, Ingolstadt (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 538 days.

(21) Appl. No.: 14/557,986

(22) Filed: Dec. 2, 2014

(65) Prior Publication Data

US 2015/0152575 A1 Jun. 4, 2015

(51) Int. Cl.
*D01H 5/32* (2006.01)

(52) U.S. Cl.
CPC ..... *D01H 5/32* (2013.01)

(58) Field of Classification Search
CPC ..... D01H 5/32
See application file for complete search history.

(56) References Cited

U.S. PATENT DOCUMENTS 3,862,473 A * 1/1975 Felix ..... B65H 51/20 19/240
4,473,924 A * 10/1984 Hartmannsgruber .. B65H 54/80 19/239
5,134,755 A * 8/1992 Jornot ..... D01H 5/42 19/239
5,248,925 A * 9/1993 Jornot ..... D01H 5/38 19/239
5,272,790 A * 12/1993 Demuth ..... D01G 21/00 19/106 R
5,377,385 A 1/1995 Jornot et al.
5,394,591 A * 3/1995 Jornot ..... D01H 5/32 19/240

(Continued)

FOREIGN PATENT DOCUMENTS

DE 103 07 415 A1 9/2003
DE 10 2006 029 639 A1 1/2008

(Continued)

OTHER PUBLICATIONS

German Search Report, dated Oct. 16, 2014.
EP Search Report, dated Apr. 28, 2015.

*Primary Examiner* — Shaun R Hurley
(74) *Attorney, Agent, or Firm* — Dority & Manning, P.A.

(57) ABSTRACT

A textile machine, especially a spinning preparation machine, with a drafting system for drafting a fiber strand fed to the textile machine, includes a compressor arranged downstream from the drafting system in a transportation direction of the fiber strand for compressing the fiber strand. A draw-off device is arranged downstream from the compressor for drawing off the drafted fiber strand. At least one entrance cylinder is provided that can be powered by a drive and one exit cylinder that can be powered by a drive. The draw-off device comprises at least one draw-off disk that can be powered by a drive. Means are provided to the textile machine to change the ratio of the circumferential speeds of the exit cylinder and the draw-off disk (=tension draft (A)) while the drafting system is operated, at least during a part of its starting phase and/or its stopping phase.

13 Claims, 6 Drawing Sheets

(56) References Cited

U.S. PATENT DOCUMENTS 5,412,301 A * 5/1995 Jornot ..... D01H 1/22 19/239
5,428,870 A * 7/1995 Rutz ..... D01H 5/32 19/240
5,544,390 A 8/1996 Hartung et al.
5,595,049 A 1/1997 Leifeld
6,088,882 A * 7/2000 Leifeld ..... D01H 5/42 19/239
6,286,188 B1 * 9/2001 Muller ..... D01G 15/64 19/236
6,289,599 B1 * 9/2001 Leifeld ..... B65H 63/062 19/23
6,292,982 B1 * 9/2001 Breuer ..... D01H 5/22 19/239
6,334,238 B2 * 1/2002 Hartung ..... D01H 5/38 19/236
6,640,392 B2 * 11/2003 Cherif ..... D01H 13/32 19/236
7,239,340 B2 * 7/2007 Breuer ..... H04N 7/183 348/143
7,735,202 B2 * 6/2010 Duda ..... D01G 23/06 19/239
7,765,648 B2 * 8/2010 Minter ..... D01G 31/006 19/239
2001/0005923 A1 7/2001 Hartung
2004/0194257 A1 * 10/2004 Dammig ..... D01H 5/38 19/236
2005/0273980 A1 12/2005 Schlichter
2006/0162129 A1 * 7/2006 Strobel ..... D01G 31/006 19/65 R

FOREIGN PATENT DOCUMENTS

JP H 08120528 A 5/1996
WO WO 95/02720 1/1995

* cited by examiner

TEXTILE MACHINE WITH VARIABLE TENSION DRAFT

FIELD OF THE INVENTION

The present invention refers to a textile machine, especially to a spinning preparation machine, with a drafting system for drafting a fiber strand being fed to the textile machine, with a compressor to compress the fiber strand placed downstream from the drafting system in a transportation direction of the drafted fiber strand, and with a draw-off device placed downstream from the compressor in the above-mentioned transportation direction for drawing off the drafted fiber strand. The drafting system comprises at least one entrance cylinder powered with the help of a drive, and the draw-off device comprises at least one draw-off disk powered with the help of a drive. Furthermore, a method for operating a corresponding textile machine is suggested.

BACKGROUND

From the state of the art, it is known—especially relating to drawing frames—that the fiber material drafted by the drafting system, which is mostly available as fiber fleece after the drafting system, is guided through a compressor (shaped like a fleece funnel, for example) and afterwards transported towards a spinning can with the help of one or several rotatable draw-off elements such as a pair of draw-off disks, for example. Here, an additional draft (a so-called tension draft) can be generated between the drafting system and the draw-off elements by selecting a higher circumferential speed of the draw-off elements than the circumferential speed of the drafting system's exit cylinder placed upstream from the compressor in transportation direction.

It is likewise known that the fiber sections of the fiber fleece drafted with the help of the drafting system enter the compressor along parallel running paths during the normal operation of the drafting system (i.e. between the corresponding starting and stopping phases, in which the circumferential speed of the exit cylinder—and with it, the feeding speed of the drafting system—turns out to be lower than during normal operation. In the compressor, they finally strike its rebounding surface, are then deflected here more or less abruptly and finally leave the compressor through a passage opening so the draw-off disks can transport them away towards the spinning can.

Although the change of direction inside the compressor mentioned above is certainly desired and leads to higher tensile strength or tear resistance (the textile engineer calls this an increase in so-called "sliver adhesion") through the corresponding swirling actions inside the compressor. As the fiber fleece moves slower during the starting and stopping phase, the flow pattern described here, however, cannot be maintained in these phases of operation of the drafting system. Rather, the individual fiber strand sections inside the compressor acquire, as a rule, a funnel-shaped flow pattern—in other words, the fiber band sections enter the compressor in parallel and with almost the same speeds (other than during the normal operation of the drafting system), so that the swirling action mentioned above does not take place and sliver adhesion turns out to be lower than during normal operation.

SUMMARY OF THE INVENTION

A task of the present invention is therefore to suggest a textile machine or method for operating it that takes this disadvantage into account. Additional objects and advantages of the invention will be set forth in part in the following description, or may be obvious from the description, or may be learned through practice of the invention.

The tasks are solved by a textile machine or method for operating it that has the characteristics set forth herein.

According to the invention, the textile machine is thus characterized by the fact that it comprises means for changing the ratio of the circumferential speeds of exit cylinder and draw-off disk—and therefore of the textile machine's tension draft—during the operation of the drafting system, wherein the change can be implemented at least during a part of the entire starting and stopping phase(s) of the drafting system or all of it.

Whereas in conventional textile machines, the tension draft corresponds to the one present during normal operation (with the associated disadvantages of lower sliver adhesion mentioned above) during the starting and stopping phases of the drafting system (i.e. in the time periods when the drafting system's feeding speed deviates from the target value given for normal operation), the present invention allows changing the tension draft during the starting and/or stopping phase of the drafting system.

The invention, in particular, allows the tension draft present at the start of the starting phase to be reduced with respect to normal operation and to gradually increase it (i.e. preferably during the starting phase) to the value preset for normal operation. Since a lower tension draft automatically leads to the fiber fleece not being drawn off as quickly from the compressor, the fleece speed is also lower inside the compressor and the desired flow pattern of the fibers is obtained, in which they enter the compressor in a more or less parallel way, where they strike a corresponding rebounding surface, which finally leads to a change of direction and the associated fiber swirling. The end result is a fiber strand with a sliver adhesion comparable to the sliver adhesion of the fiber fleece that leaves the compressor during the normal operation of the drafting system.

Furthermore, the adjustment of the tension draft mentioned above makes it finally possible to influence the sliver adhesion in a positive way during the stopping phase as well, since a change of the tension draft entails an improvement of the flow pattern here as well.

It is especially advantageous if the textile machine has means for changing the ratio of the circumferential speeds of entrance and exit cylinder (=draft of the drafting system) while the drafting system is operating, at least during its starting and/or stopping phase, depending on the change of the tension draft. For example, at the start of the starting phase, it could be conceivable to select the drafting system's draft higher at first (e.g. by increasing the main draft, defined as the ratio of the middle cylinder and exit cylinder circumferential speeds) than during normal operation, and to gradually lower it during the starting phase to the value intended for normal operation. If the tension draft is increased accordingly at the same time from a lower value, then it is possible to maintain the overall draft (i.e. the sum of drafting system's draft and tension draft) constant. The fiber fleece produced in this way is finally characterized by a constant uniformity and a correspondingly uniform sliver adhesion.

It is also advantageous if the drafting system has at least one middle cylinder powered with the help of a drive, in which case the textile machine should comprise means for changing the ratio of the middle cylinder and exit cylinder circumferential speeds (=main draft) while the drafting system is operating, at least during a starting and/or stopping phase of the drafting system, depending on the change of the tension draft. For example, in this connection, it could be conceivable to change the drafting system's draft by changing the main draft, in which case the preliminary draft of the drafting system (=ratio of the circumferential speeds of entrance cylinder and middle cylinder) could remain constant. In this case, the main draft should be changed in such a way that the overall draft remains as constant as possible in spite of changing the tension draft over the entire drafting system's operation.

It is furthermore advantageous if the drafting system comprises at least one middle cylinder powered by a drive, wherein the textile machine could include means for changing the ratio of the circumferential speeds of entrance cylinder and middle cylinder (=preliminary draft) during the operation of the drafting system, at least during its start and/or stopping phase, depending on the change of the tension draft. In this case, it could be possible to change the overall draft by changing the main draft and the preliminary draft or by changing the preliminary draft while maintaining the main draft constant. It could also be advantageous in this case if the corresponding change takes place in such a way that the overall draft of the textile machine during the starting phase and/or stopping phase would at least adopt roughly the value present during normal operation.

It is especially advantageous if the drive for powering the draw-off disk(s) and/or the drive for powering the exit cylinder are executed as an individual drive. As a result of this, a simple adjustment or change of the tension draft is possible. It could, for example, be conceivable to increase the circumferential speed of the draw-off disks faster during the starting phase than the circumferential speed of the exit cylinder to ultimately carry out a corresponding increase of the tension draft. It could likewise be possible to throttle the circumferential speed of the draw-off disks slower during the stopping phase than the circumferential speed of the draw-off cylinder to gradually reduce the tension draft during the stopping phase.

It is also advantageous if the tension draft, the preliminary draft, the main draft, the drafting system' draft and/or the overall draft, can be changed especially by changing the circumferential speed of the entrance cylinder, the middle cylinder, the exit cylinder and/or the draw-off disk accordingly, with the help of a control unit. While mechanical solutions are also conceivable for changing the tension draft or the other drafts mentioned above depending on the feeding speed of the exit cylinder, the individual values can be changed with the help of the corresponding control unit. For example, in this connection, it could be conceivable to store the corresponding mathematical models in the control unit so the latter can use them as basis for adjusting the relevant circumferential speed (e.g. by changing the rotational speed explicitly). To accomplish this, all cylinders or selected ones and one or several draw-off disks can be connected to an individual drive to allow customized regulation of the individual circumferential rotational speeds as much as possible.

It is especially advantageous if the control unit is designed to increase the circumferential speed of the draw-off disk faster or slower, at least during a part of the starting and/or stopping phase of the drafting system, than the circumferential speed of the exit cylinder. It is especially advantageous if, during the starting phase, the circumferential speed of the draw-off disks is increased faster than the circumferential speed of the exit cylinder, so that the tension draft is increased from a relatively low value during the starting phase to a value intended for normal operation. It is likewise advantageous to reduce the circumferential speed of the exit cylinder during the stopping phase of the drafting system less quickly than the circumferential speed of the draw-off disks, so that the tension draft is throttled from a value prevailing during normal operation to a value relatively lower.

Generally, it should be pointed out here that there can naturally also be cases in which it is advantageous to throttle the tension draft during the starting phase from a higher value compared to normal operation to the value desired during normal operation or to increase the tension draft accordingly during the stopping phase. The selection of the corresponding change can depend especially on the fiber material to be drafted, as this influences the respective flow pattern of the individual fiber sections inside the compressor.

It is additionally advantageous for the control unit to be designed so it can change the tension draft, at least during a part of the drafting system's starting and/or stopping phase in proportion to the change of circumferential speed of the exit cylinder. In other words, it could make sense to increase or decrease the tension draft only when the circumferential speed of the exit cylinder also changes.

It is advantageous to design the control unit so it can change the tension draft, at least during a part of the drafting system's starting and/or stopping phase depending on the circumferential speed of the exit cylinder, in which case the change takes place preferably based on a mathematical model. Thus, calculation models can be stored in the control unit to determine the acceleration of the exit cylinder and the draw-off disks during the starting phase or their rotational speed reduction during the stopping phase. The models can also rely on database data, in which case the data contain preferably one or several characteristic parameters of the fiber strand that were determined empirically if possible. Some of them are, for example, the type and composition of the fiber strand or the desired sliver adhesion. Likewise, parameters of the textile machine or of the desired drafting process should be considered, in which case, for example, the preliminary draft, the main draft, the circumferential speed of the entrance, middle and/or exit cylinder—and with it, the feeding speed of the drafting system—and/or the overall draft can flow into the corresponding calculations. Likewise, an individual calculation of the individual magnitudes can also be dispensed with. To do this, databases could be stored, for example, so that when parameters characteristic of the fiber strand are entered, the right adjustment of the tension draft and/or of the overall draft is/are automatically made available and can be considered by the control unit when the respective parameters of the drafting process are regulated.

It is additionally advantageous to design the control unit so it can—at least during a part of the drawing frame's starting and/or stopping phase—change the drafting system's draft, particularly by changing the main draft and preferably depending on the circumferential speed of the exit cylinder and/or of the circumferential speed of the draw-off disk. In other words, the drafting system's draft is preferably geared to the circumferential speed of the exit cylinder so a constant draft can be carried out as much as possible during the entire operation of the drafting system. In this case, the drafting system's draft is not constant during the starting and stopping phases. Rather, a gradual reduction during the starting phase and a gradual increase during the stopping phase take place.

It is also advantageous to design the control unit so it can increase the drafting system's draft, at least during a part of the drafting system's starting and/or stopping phase, especially by changing the main draft and at the same time to decrease the tension draft or reduce the drafting system's draft while simultaneously increasing the tension draft. In both cases, it is possible to maintain the overall draft constant as much as possible, although it must be pointed out here for the entire description that the increase or reduction of the tension draft and/or of the drafting system's draft (or of the overall draft)—and in this case, especially the increase or decrease of the circumferential speeds of the entrance, middle and/or exit cylinder and/or of the draw-off disks—can take place linearly (needless to say, a non-linear regulation of the above-mentioned drafts or circumferential speeds is conceivable).

It is especially advantageous to design the control unit so it can regulate the tension draft and the drafting system's draft, especially by changing the main draft at least during a part of the starting and/or stopping phase of the drafting system, in such a way that the overall draft remains constant or at least deviates by no more than 5%, preferably by no more than 3%, very preferably by no more than 2%, from a target value preset for the prevailing normal operation of the drafting system between the starting and stopping phase. The overall draft therefore remains preferably constant or at least almost constant during the entire drafting process (starting phase—normal operation—stopping phase) so that a fiber fleece can be produced with high uniformity and above all with a sliver adhesion that is as uniform as possible.

The process according to the invention is finally characterized by changing the tension draft during the operation of the drafting system, at least during a part of its starting and/or stopping phase. In particular, it is in this case advantageous if—apart from the tension draft—the drafting system's draft is also changed, especially by changing the main draft, in which case the changes should occur in such a way that the overall draft remains constant or at least deviates from a target value by no more than 5%, preferably by no more than 3%, very preferably by no more than 2%, preset for the normal operation of the drafting system that prevails between the starting and stopping phase. It is furthermore advantageous if the drafting system's draft is increased when the tension draft is reduced or the drafting system's draft is reduced when the tension draft is increased.

Regarding the individual process characteristics or their advantages, reference is made to the previous and subsequent description, pointing out expressly that the individual characteristics can be embodied in any desired combination.

BRIEF DESCRIPTION OF THE DRAWINGS

Further advantages of the invention are described in the embodiments below, which show.

DETAILED DESCRIPTION

Figure 1:
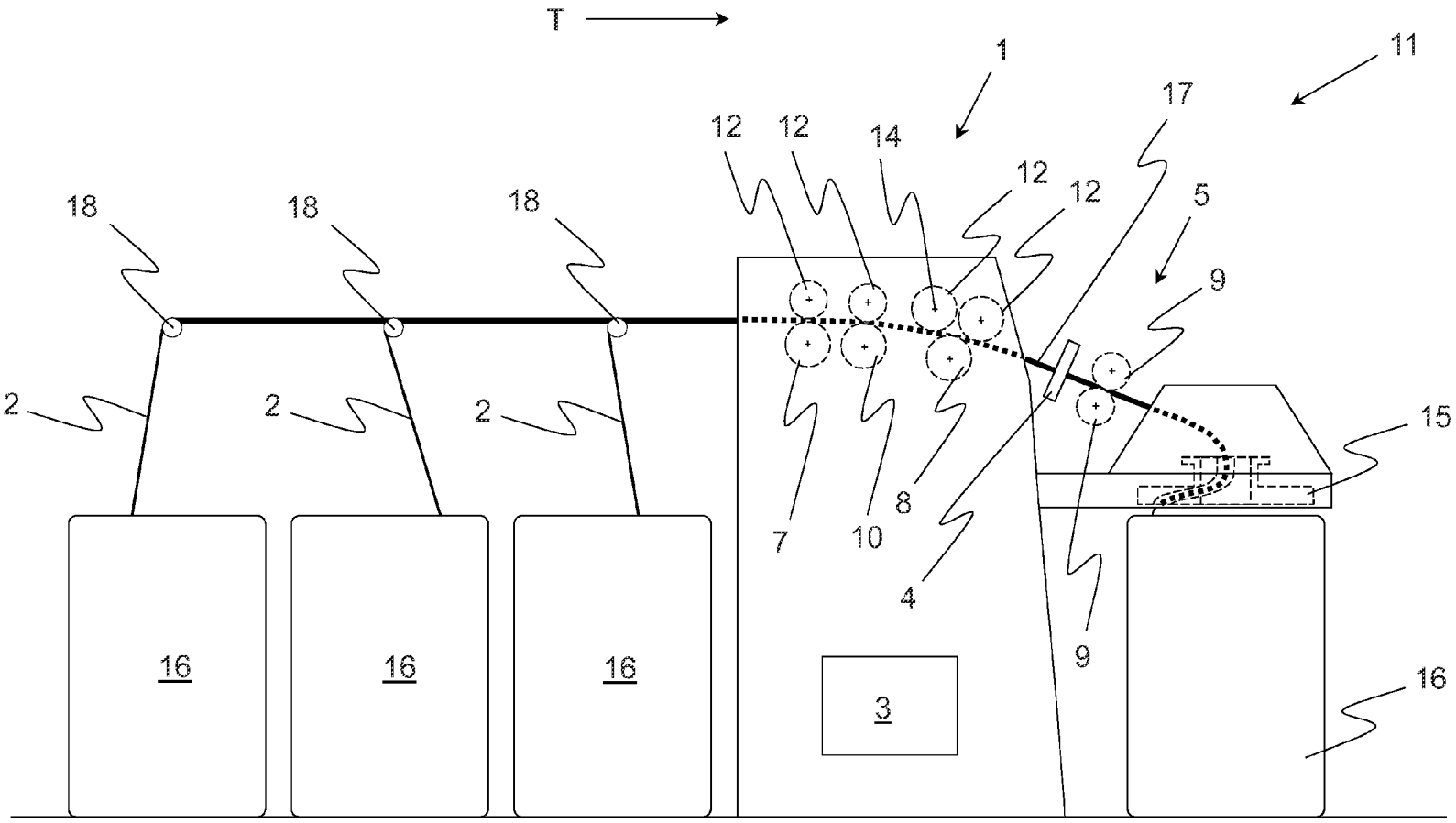
FIG. 1 is a schematic lateral view of a drawing frame.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a lateral view schematically and, as an example of a textile machine 11 according to the invention, a drawing frame for drafting (homogenizing) a rope-shaped fiber strand 2. While the drawing frame is operating, the fiber strand 2 (e.g. in form of fiber slivers) is pulled out of one or several so-called spinning cans 16 with the help of a drawing-off arrangement and fed via corresponding deflections 18 to the respective drafting system 1 of the drawing frame (or, in the case of a multi-headed drawing frame, to the drafting systems 1 of the drawing frame).

As a rule, the drafting system 1 consists of three or more roller pairs that in each case can comprise at least one lower roller and one upper roller. The desired draft of the fiber strand 2 is ultimately created because the individual cylindrical lower rollers, and with them, also the individual upper rollers making contact with them, have an increasingly higher circumferential speed in the transportation direction T of the fiber strand 2 shown. Although other solutions are also conceivable, the drafting system 1 in the embodiments shown has lower rollers shaped like an entrance cylinder 7, a middle cylinder 10, and an exit cylinder 8. The individual cylinders 7, 8, 10, in turn, make contact with one or several counter cylinders 12, so that the fiber strand 2 can be guided in a clamped way. The transportation direction increases the circumferential speeds of the above-mentioned cylinders 7, 8, 10, resulting ultimately in drafting and thus homogenizing the fiber strand 2.

After the drafting system 1, the drafted fiber material (=fiber fleece 17) is finally guided through a compressor 4 preferably designed as fleece funnel, which compresses the fiber fleece 17.

Afterwards, the fiber fleece 17 passes the compressor 4 and reaches the area of a draw-off device 5, which generally comprises several rotatable or at least partially driven draw-off elements, for example in form of two draw-off disks 9 making contact with the fiber fleece 17 from two sides. Owing to a correspondingly high transportation speed, the draw-off device 5 causes an additional draft and, with it, an increase in the tensile strength of the fiber fleece 17. Finally, the fiber fleece 17 is generally fed to a rotating turntable 15, which deposits it loop-like in a spinning can 16 made available.

Figure 2:
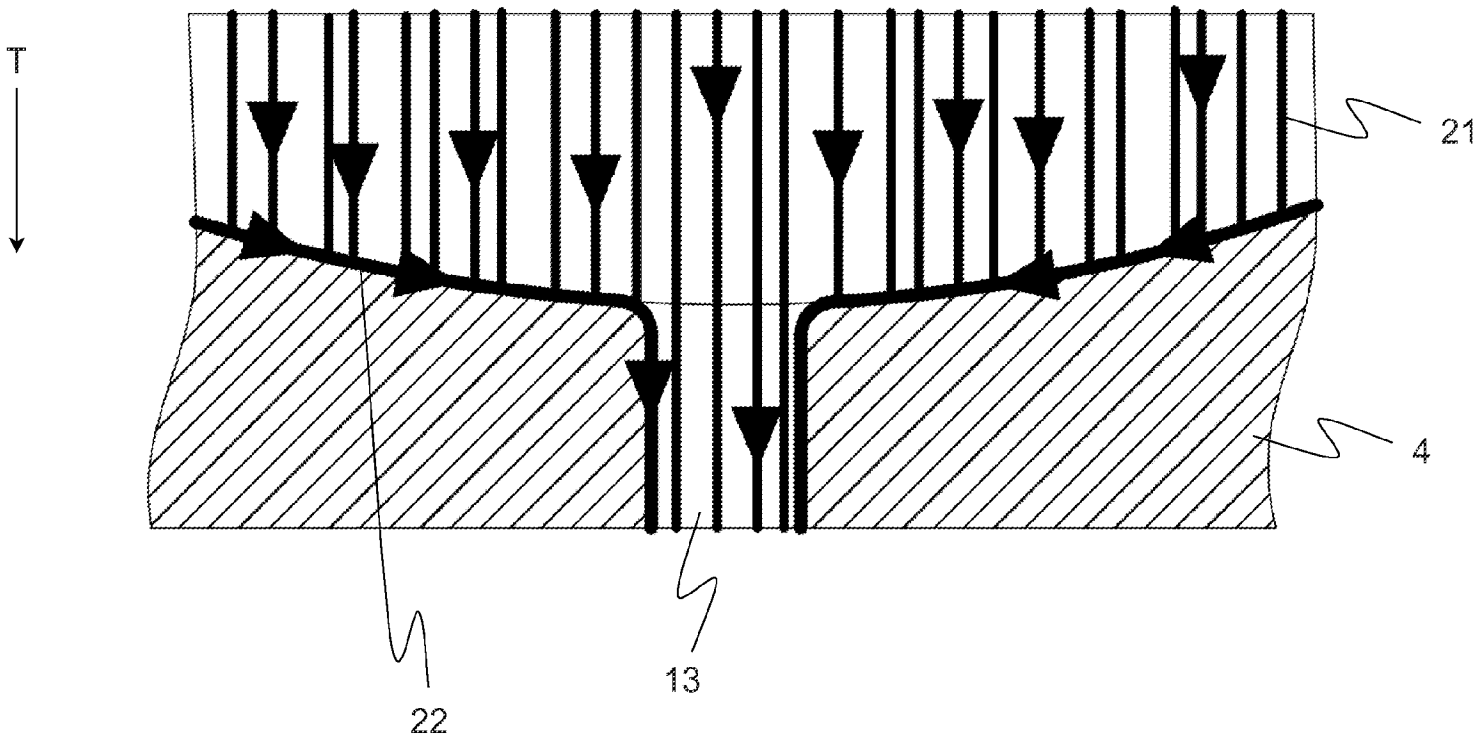
FIG. 2 is a partially cut view of a compressor during normal operation of a drafting system.
Figure 3:
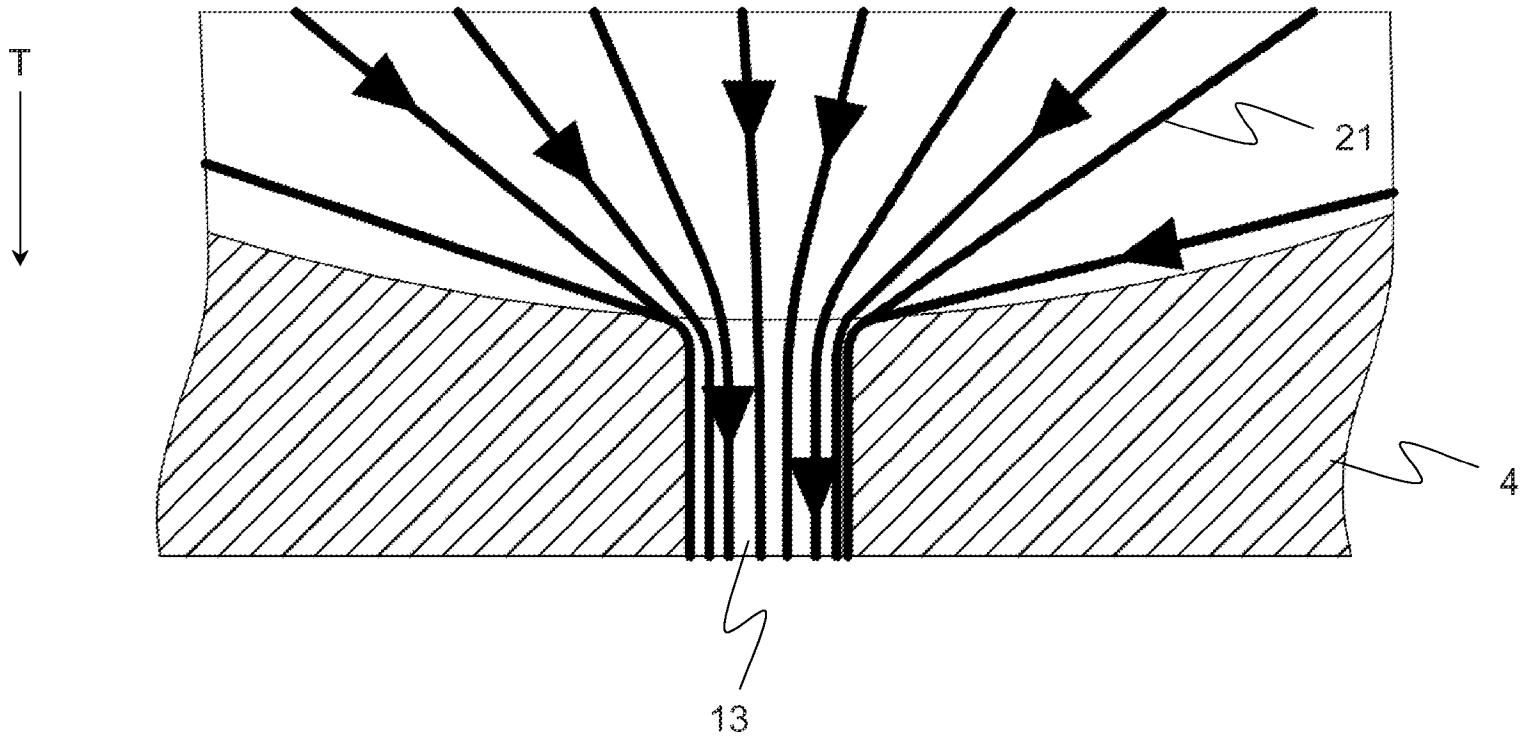
FIG. 3 is a partially cut view of a compressor during the normal operation of a drafting system known from the state of the art during one of its starting or stopping phases.

The basic path of the fiber fleece 17 or its fiber sections 21 during the operation of the drafting system is made clear in FIGS. 2 and 3.

A lateral view of a partially cut compressor 4 is shown. In this example, it is shown as a fleece funnel that brings about a joining together of the fiber sections 21 of the fiber fleece coming from above in FIGS. 2 and 3. Here, the fiber fleece 17 ultimately leaves the compressor 4 through a corresponding passage opening 13.

As can be seen in FIG. 2, which shows schematically the path of the fiber sections 21 of the fiber fleece 17 during normal operation of the drafting system 1, the fiber sections 21 reach the compressor 4 along more or less parallel paths and finally strike its floor area 22 (the compressor 4 is for this reason often named "striking funnel"). Thus, the fiber sections 21 of the fiber fleece 17 come out of the clamping zone of the exit cylinder 8 and its counter cylinder 12 with high speed and strike the floor area 22 (i.e. the swirling zone)

of the compressor 4 without significant change of direction. Owing to the ensuing reversal of direction and the further transportation towards the passage opening 13, the fiber sections 21 from the edge area of the fiber fleece 17 cover a significantly longer distance than the fiber sections 21 from the middle area of the fiber fleece 17. When the fiber sections 21 strike, they are therefore swirled among one another. The result is a fiber fleece 17 with a desired additional tensile strength, known generally as "sliver adhesion".

However, the path of the fiber sections 21 of the fiber fleece 17 shown in FIG. 2 results only during normal operation 016 (FIG. 4) of the drafting system 1, i.e. during the phase lying between its starting and stopping phases I, III (differing, among other things, by a slower feeding speed L of the drafting system 1, i.e. having a slower circumferential speed of the exit cylinder 8 from normal operation II).

Comparing FIGS. 2 (normal operation II) and 3 (starting or stopping phase I, III), the fiber sections 21 of the fiber fleece 17 no longer enter the compressor 4 in parallel paths during the starting and stopping phase I, III (FIG. 2). Rather, a funnel-shaped movement pattern occurs, explained by the lower speed of the individual fiber sections 21 in the time windows mentioned above (once again resulting from the slower circumferential speed of the exit cylinder 8). Here, the fiber sections 21 from the edge area of the drafting system 1 do not move straight on the floor area 22 towards the compressor 4, but are more likely to be taken along by the adjacent fiber sections 21 and therefore take a path that turns out to be shorter than the one that they would have traveled during normal operation II. As a result of this, the fiber sections 21 are ultimately guided more uniformly and less swirled than in normal operation II of the drafting system 1. This finally leads to the production of a fiber fleece 17 with considerably less sliver adhesion owing to the absence of swirling.

To counteract this disadvantage, this invention now suggests changing the ratio of the circumferential speeds of exit cylinder 8 and draw-off disk 9 (=tension draft A) during the operation of the drafting system 1, at least during part of its starting and/or stopping phase I, III. In this way it is possible, as shown in the following, to avoid the flow pattern shown in FIG. 3 during the starting and stopping phase I, III. Rather, a flow pattern as similar as possible to the one shown in FIG. 2 results from the method according to the invention or with the help of the textile machine 11 according to the invention, also during the above-mentioned phases outside of normal operation II.

In this connection, an increase in the tension draft A (FIG. 4) during the starting phase I from an initial value to a final value is provided, and this corresponds to the value desired during normal operation II of the drafting system 1 (here, the tension draft A is increased preferably by increasing the circumferential speed of the draw-off disk 9 faster than the circumferential speed of the exit cylinder 8). Since the tension draft A is defined as the ratio of the circumferential speeds of exit cylinder 8 and draw-off disk 9, a lower tension draft A means a slower drawing off of the fiber fleece 17 from the compressor 4. The fiber fleece 17 is thus quasi compressed inside the compressor 4, so that the flow pattern shown in FIG. 3 can be approximated to the one shown in FIG. 2. A possible connection between the circumferential speed of the exit cylinder 8, i.e. of the feeding speed L of the exit cylinder 8—and with it, of the drafting system 1—and the tension draft A during the starting phase I results from FIG. 4. Thus, an increase in the feeding speed L of the exit cylinder 8 and of the tension draft A can be provided until normal operation II is reached.

It is ultimately just as conceivable to reduce the tension draft A during the stopping phase III together with the feeding speed L of the exit cylinder 8 (by reducing the circumferential speed of the draw-off disk 9 slower than the circumferential speed of the exit cylinder 8) in order to increase the above-mentioned sliver adhesion during the stopping phase III too.

Figure 4:
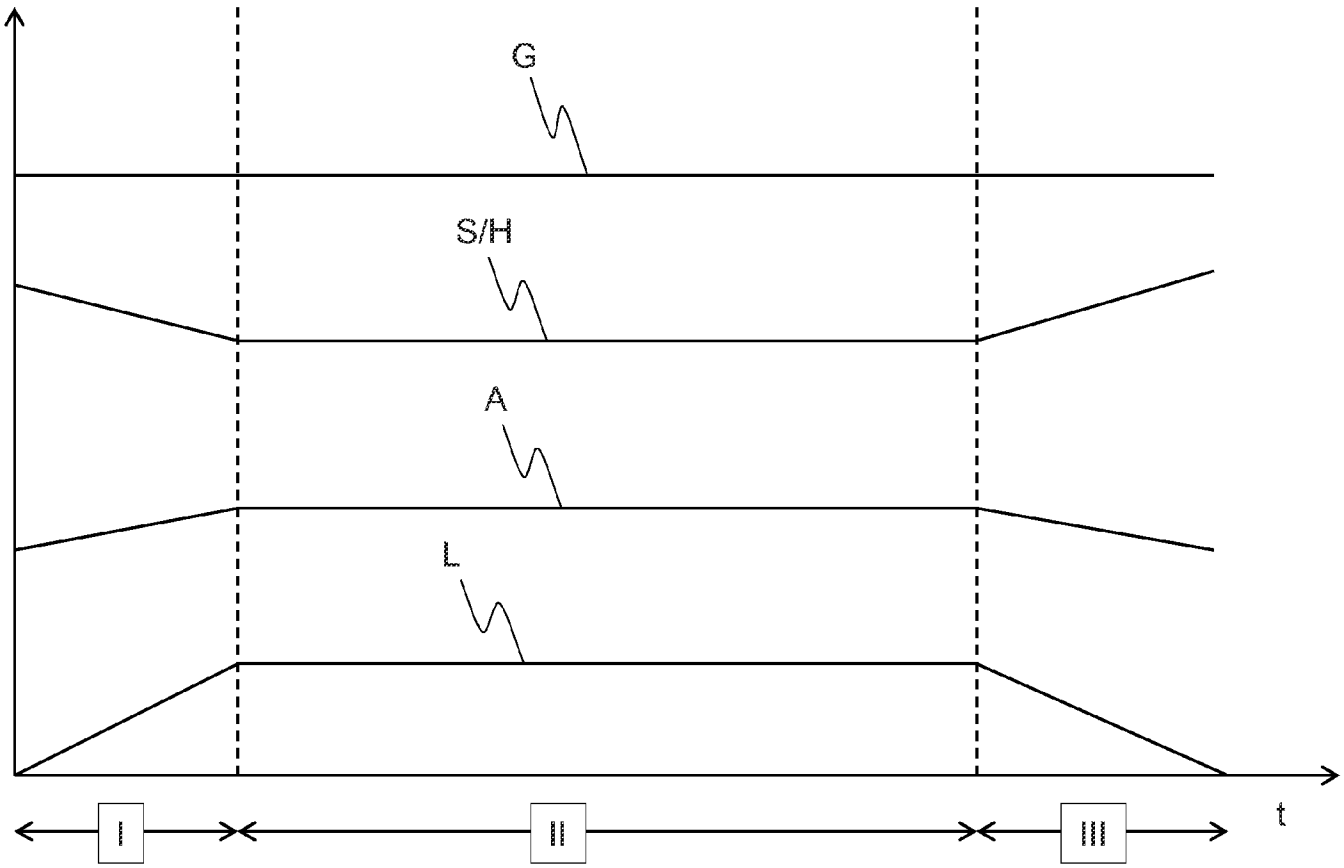
FIG. 4 is a schematic representation of individual parameters of a textile machine according to the invention.

Generally, it must be pointed out with respect to FIG. 4 that it merely provides a schematic view of the course of the drafting system's draft S (or main draft H), tension draft A, feeding speed L of the exit cylinder 8 and overall draft G over time t. However, FIG. 4 contains no statements about the amounts of the respective changes. Likewise, the changes shown do not have to take place linearly, so that changes that follow a non-linear function are also conceivable.

Another advantageous further development of the invention is also shown in FIG. 4. It is this an enormous advantage if during the starting phase I the drafting system's draft S (ratio of the circumferential speeds of entrance cylinder 7 and exit cylinder 8) is simultaneously reduced from an initial value to one desired during normal operation II. This can take place, for example, by gradually reducing the main draft H (=ratio of the circumferential speeds of middle cylinder 10 and exit cylinder 8) of the drafting system 1 under constant preliminary draft (=ratio of the circumferential speeds of entrance cylinder 7 and middle cylinder 10). Analogously, it is finally also conceivable to increase the drafting system's draft S during the stopping phase III too by increasing the main draft H, for example. In the final analysis, the change of the drafting system's draft S ensures that the overall draft G (=ratio of the circumferential speeds of entrance cylinder 7 and draw-off disk 9) of the textile machine 11 remains roughly constant throughout its operation (see curve "G" in FIG. 4).

Figure 5:
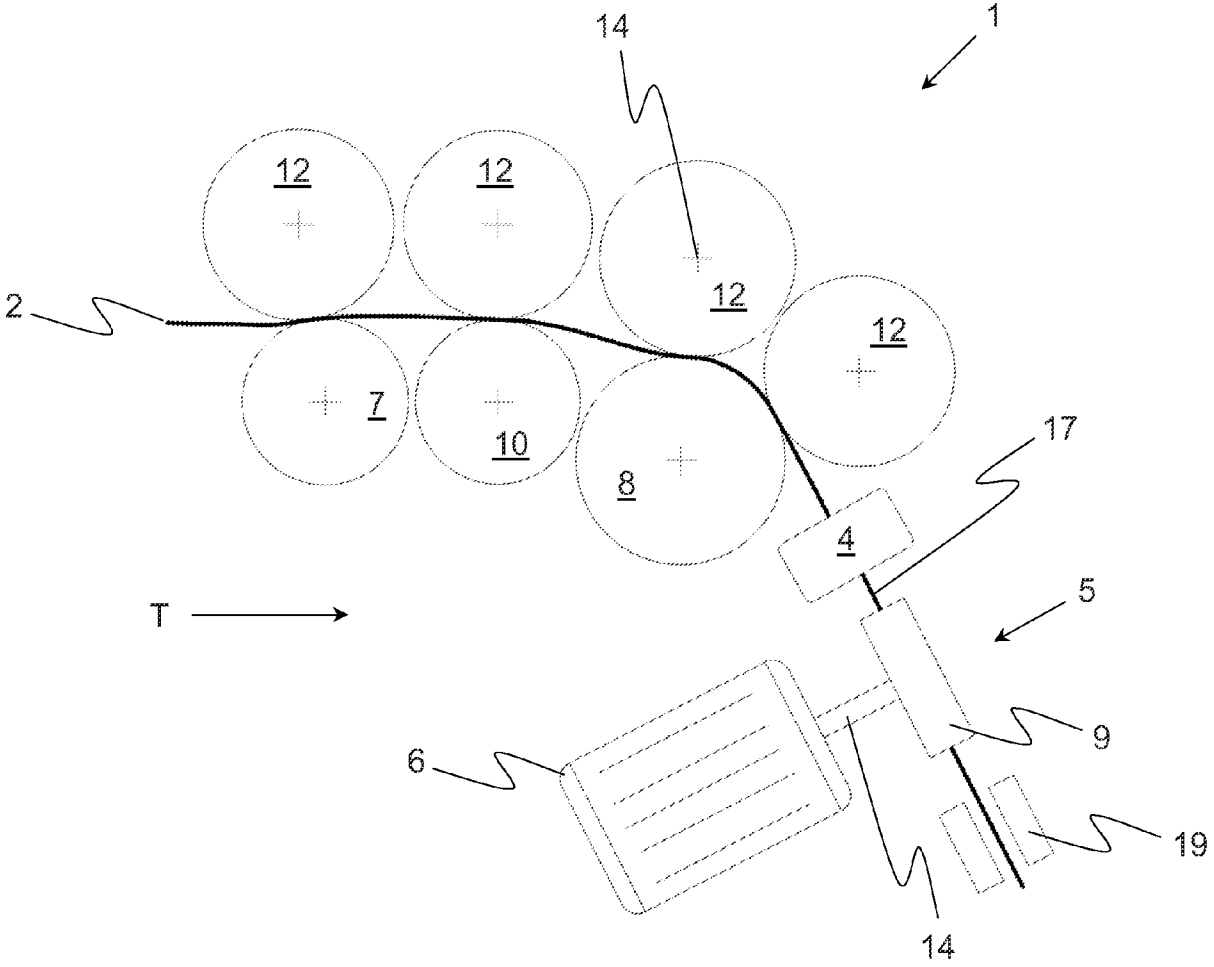
FIG. 5 is a schematic section of a textile machine according to the invention.
Figure 6:
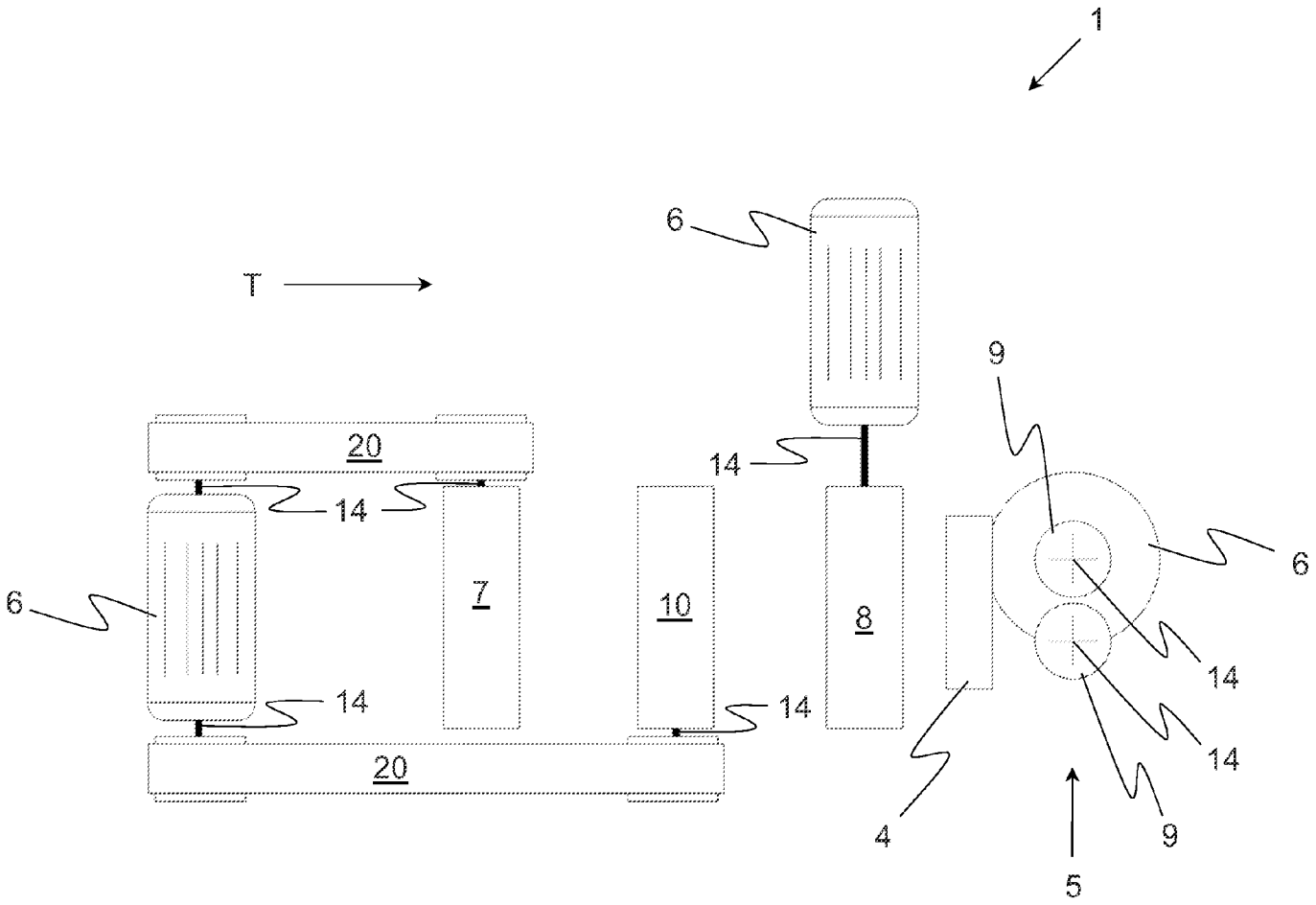
FIG. 6 is a schematic section of another textile machine according to the invention.

Finally, FIGS. 5 and 6 show possible embodiments of the textile machine 11 according to the invention.

As these figures show, it is advantageous if the draw-off disks 9 (or at least one of preferably two draw-off disks 9) are powered with the help of a drive 6 executed as an individual drive. As a result of this, the tension draft A can be adjusted to each point in time by changing the rotational speed of the drive 6. To do this, the drive 6 should be connected preferably to a control unit 3 indicated in FIG. 1. It can furthermore be seen in FIGS. 5 and 6 that it can be advantageous if the rotational axes 14 (for clarity reasons, only one of the rotational axes generally identified with a cross is provided with a reference sign) of the draw-off disks 9 and/or the rotational axis 14 of the drive 6 powering the draw-off disk(s) 9 runs skewed with respect to at least one rotational axis 14 of the cylinders 7, 8, 10, 12 of the drafting system 1 mentioned above. For example, it is conceivable that the rotational axes 14 of the above-mentioned drive 6 and/or of the draw-off disks 9 run perpendicular to the rotational axes of cylinders 7, 8, 10, 12 of the drafting system 1 in the lateral view shown in FIG. 5.

The end result is therefore to suggest a textile machine 11 or method for operating it in which the overall draft G remains roughly constant in spite of changing tension draft A, thus making a uniform draft of the fiber strand 2 possible with maximum optimal sliver adhesion possible. In order to also regulate the described main draft H or the drafting system's draft S mentioned above according to the present invention, the entrance cylinder 7, the middle cylinder 10 and/or the exit cylinder 8 can be provided with the respective individual drives, as indicated in FIG. 6, for example (here, the entrance cylinder 7 and the middle cylinder 10 are connected to a drive 6 executed as a twin shaft engine with a corresponding belt 20, so the preliminary draft is always constant).

To conclude, reference is made to FIG. 5, which shows a sensor 19 placed after the draw-off disks 9. This sensor can, in turn, be connected to the above-mentioned control unit 3 and designed to detect the speed of the fiber fleece 17. Ultimately, the textile machine 11 has in this case a sensor 19 to determine the tension draft A at the exit of the drafting system 1 when the fiber strand speed is known.

The present invention is not restricted to the embodiments shown and described. Variations within the scope of the patent claims are just as possible as a combination of characteristics, even if they are shown and described in different embodiments, in the patent claims or in the general description.

The invention claimed is:

1. A textile machine for a spinning preparation machine, the textile machine comprising:

a drafting system configured to draft a fiber strand fed to the textile machine, the drafting system further comprising an entrance cylinder powered by a drive, and an exit cylinder powered by a drive;

a compressor arranged downstream from the drafting system in a transportation direction of the fiber strand that compresses the fiber strand;

a draw-off device arranged downstream from the compressor that draws off the drafted fiber strand, the draw-off device further comprising a draw-off disk powered by a drive;

means for changing a ratio of circumferential speeds of the exit cylinder and the draw-off disk (tension draft) while the drafting system is operated during one or both of a part of a starting phase and a stopping phase of the drafting system; and, a control unit that is configured with the means for changing a ratio of circumferential speed of the exit cylinder and draw-off disk to, at least during a part of the starting phase or the stopping phase of the drafting system, increase the circumferential speed of the draw-off disk faster or slower than the circumferential speed of the exit cylinder, or to reduce the circumferential speed of the draw-off disk faster or slower than the circumferential speed of the exit cylinder.

2. The textile machine according to claim 1, wherein the drive for the draw-off disk and the drive for the exit cylinder are individual respective drives.

3. The textile machine according to claim 1, further comprising means for changing a ratio of circumferential speeds of the entrance cylinder and the exit cylinder (drafting system's draft) while the drafting system is operated during one or both of the starting phase and the stopping phase of the drafting system depending on the change of the tension draft.

4. The textile machine according to claim 3, wherein the drafting system further comprises a middle cylinder powered by a drive, and further comprising means for changing a ratio of circumferential speeds of the middle cylinder and the exit cylinder (main draft) while the drafting system is operated during one or both of the starting phase and stopping phase of the drafting system depending on the change of the tension draft.

5. The textile machine according to claim 4, wherein the drafting system further comprises a middle cylinder powered by a drive, and further comprising means for changing a ratio of circumferential speeds of the entrance cylinder and the middle cylinder (preliminary draft) while the drafting system is operated during one or both of the starting phase and the stopping phase of the drafting system depending on the change of the tension draft.

6. The textile machine according to claim 5, wherein the tension draft, the preliminary draft, the main draft, the drafting system's draft, and an overall draft (ratio of circumferential speeds of the entrance cylinder and the draw-off disk), are changed by changing the circumferential speeds of the entrance cylinder, the middle cylinder, the exit cylinder, and the draw-off disk with the control unit.

7. The textile machine according to claim 6, wherein the control unit is configured to change the tension draft during one or both of the starting phase and the stopping phase of the drafting system in proportion to the change of the circumferential speed of the exit cylinder.

8. The textile machine according to claim 6, wherein the control unit is configured to change the tension draft during one or both of the starting phase and the stopping phase of the drafting system depending on the circumferential speed of the exit cylinder, wherein the change is based on a mathematical model and data from a data base of the textile machine containing characteristic parameters of the fiber strand.

9. The textile machine according to claim 6, wherein the control unit is configured to change the drafting system's draft during one or both of the starting phase and the stopping phase of the drafting system by changing the main draft depending on one or both of the circumferential speed of the exit cylinder and the circumferential speed of the draw-off disk.

10. The textile machine according to claim 6, wherein the control unit is configured to increase the drafting system's draft by changing the main draft during one or both of the starting phase and the stopping phase of the drafting system and, at the same time, to reduce the tension draft or to reduce the drafting system's draft while increasing the tension draft.

11. The textile machine according to claim 6, wherein the control unit is designed to regulate the tension draft and the drafting system's draft by changing the main draft during one or both of the starting phase and the stopping phase of the drafting system such that the overall draft deviates by no more than 5% from a target value preset for the normal operation of the drafting system.

12. A method for operating a textile machine, wherein the textile machine comprises:

a drafting system configured to draft a fiber strand fed to the textile machine, the drafting system further comprising an entrance cylinder powered by a drive, and an exit cylinder powered by a drive;

a compressor arranged downstream from the drafting system in a transportation direction of the fiber strand that compresses the fiber strand;

a draw-off device arranged downstream from the compressor that draws off the drafted fiber strand, the draw-off device further comprising a draw-off disk powered by a drive;

the method comprising changing a ratio of circumferential speeds of the exit cylinder and the draw-off disk (tension draft) while the drafting system is operated during one or both of a part of a starting phase and a stopping phase of the drafting system and changing the drafting system's draft by changing a main draft such that an overall draft during one or both of a part of a starting phase and a stopping phase of the drafting system deviates by no more than 5% from a target value preset for the normal operation of the drafting system.

13. The method according to claim 12, wherein the drafting system's draft is increased when the tension draft is reduced, or the drafting system's draft is reduced when the tension draft is increased during the starting phase and the stopping phase of the drafting system, respectively.

* * * * *